US007193518B2

(12) United States Patent
Kiwada et al.

(10) Patent No.: US 7,193,518 B2
(45) Date of Patent: Mar. 20, 2007

(54) IMAGE FORMING DEVICE, PROCESSING DEVICE AND METHOD USING SAME

(75) Inventors: Masakatsu Kiwada, Sagamihara (JP); Kazuto Yamamoto, Kunitachi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 265 days.

(21) Appl. No.: 11/035,743

(22) Filed: Jan. 18, 2005

(65) Prior Publication Data

US 2006/0038685 A1 Feb. 23, 2006

(30) Foreign Application Priority Data

Aug. 17, 2004 (JP) ..... 2004-237114

(51) Int. Cl.
*G08B 13/14* (2006.01)

(52) U.S. Cl. ..... 340/572.1; 399/1

(58) Field of Classification Search ..... 340/572.1; 399/1, 365, 8; 355/40; 235/375, 432, 433
See application file for complete search history.

(56) References Cited

U.S. PATENT DOCUMENTS

| | | | | |
|---|---|---|---|---|
| 6,381,418 | B1 * | 4/2002 | Spurr et al. | 355/40 |
| 6,694,115 | B2 * | 2/2004 | Weaver | 399/80 |
| 6,739,767 | B2 * | 5/2004 | Ikeda et al. | 355/32 |
| 6,982,802 | B2 * | 1/2006 | Borg et al. | 399/8 |
| 7,003,256 | B2 * | 2/2006 | Kumakura et al. | 399/366 |
| 7,129,840 | B2 * | 10/2006 | Hull et al. | 340/568.1 |

FOREIGN PATENT DOCUMENTS

JP 2001-229199 8/2001

* cited by examiner

*Primary Examiner*—John Tweel, Jr.
(74) *Attorney, Agent, or Firm*—Buchanan Ingersoll & Rooney PC

(57) ABSTRACT

A device identifies the finishing location on a recording medium and also identifies the electronic tag location on the recording medium when a finishing instruction is included in a job. Moreover, when the finishing location matches with the electronic tag location, the device displays that the locations overlap with each other.

27 Claims, 17 Drawing Sheets

FIG. 4

300

310

< IC tag information >
< IC tag presence > Exists < /IC tag presence >
< IC tag serial number > S10002002 < /IC tag serial number >
< IC tag location > (10, 100) – (20, 110) mm < /IC tag location >
< IC tag information >

320

< Paper information >
< Paper size > A4 (210 mm X 297 mm) < /Paper size >
< Type of paper > Normal paper < /Type of paper >
< Page > Null < /Page >
< Image size > Null < /Image size >
< Image color > Null < /Image color >
...
< /Paper information >

FIG. 7

400

401

JOB INFORMATION

| | |
|---|---|
| JOB ID | 00009317 |
| USER NAME | yamamoto |
| JOB NAME | patent.doc |
| NO. OF COPIES | 1 |
| STAPLING PROCESS | TWO-POINT CENTER STAPLING |
| PUNCHING PROCESS | NO |
| FOLDING PROCESS | CENTER FOLDING |
| TRIMMING PROCESS | NO |
| .... | .... |

402

PAGE INFORMATION

| | |
|---|---|
| PAGE NO. | 1 |
| IMAGE SIZE | 289×202mm |
| PAPER SIZE | 297×210mm |
| TYPE OF PAPER | NORMAL PAPER |
| COLOR | MONOCHROMATIC BINARY |
| IMAGE ORIENTATION | PORTRAIT |
| PAPER FEEDING TRAY | AUTOMATIC SELECTION |
| SINGLE SIDE/DOUBLE SIDE | DOUBLE SIDE LEFT STITCH |
| .... | .... |

402

PAGE INFORMATION

| | |
|---|---|
| PAGE NO. | 2 |
| IMAGE SIZE | 289×202mm |
| PAPER SIZE | 297×210mm |
| TYPE OF PAPER | NORMAL PAPER |
| COLOR | MONOCHROMATIC BINARY |
| IMAGE ORIENTATION | PORTRAIT |
| PAPER FEEDING TRAY | AUTOMATIC SELECTION |
| SINGLE SIDE/DOUBLE SIDE | DOUBLE SIDE LEFT STITCH |
| .... | .... |

⋮

FIG. 8

500

| TYPE OF FINISHING PROCESS | DETAIL ITEMS | FINISHING POSITION |
|---|---|---|
| STAPLING PROCESS | CORNER STAPLING | AREAS 611-614 OF FIG. 8 (FOUR PATTERNS) |
| | TWO-POINT SIDE STAPLING | AREAS 621-624 OF FIG. 9 (FOUR PATTERNS) |
| | TWO-POINT CENTER STAPLING | AREAS 631 and 632 OF FIG. 10 (TWO PATTERNS) |
| PUNCHING PROCESS | TWO-POINT SIDE PUNCHING | AREAS 641-644 OF FIG. 11 (FOUR PATTERNS) |
| | THREE-POINT SIDE PUNCHING | AREAS 651-654 OF FIG. 12 (FOUR PATTERNS) |
| FOLDING PROCESS | CENTER FOLDING | AREAS 661 and 662 OF FIG. 13 (TWO PATTERNS) |
| | Z-FOLDING | AREAS 671 and 672 OF FIG. 14 (TWO PATTERNS) |
| TRIMMING (CUTTER) PROCESS | — | AREAS 681-684 OF FIG. 15 (FOUR PATTERNS) |

IMAGE FORMING DEVICE, PROCESSING DEVICE AND METHOD USING SAME

This application is based on Japanese Patent Application No. 2004-237114 filed on Aug. 17, 2004, the contents of which are hereby incorporated by reference.

BACKGROUND OF THE INVENTION

1. Field of the Invention

The invention relates to an image forming device and/or a processing device and a method of image forming, finishing, or processing. The invention relates to, in particular, an image forming device and an image forming method, which are capable of executing finishing processes on a printed recording medium.

2. Description of the Related Art

A technology has been known for storing various kinds of information such as document information printed on paper provided with an IC tag capable of storing electronic data (Unexamined Publication No. JP-A-2001-229199). Such a technology makes it easy to search and manage various kinds of information.

On the other hand, there are image forming devices that enable to execute finishing processes such as punching holes on the edge of printed paper for filing purpose. In addition to punching, there are other finishing processes such as stapling, folding and trimming.

However, if paper provided with an electronic tag, such as an IC tag, is used, there is always a risk of damaging the IC tag during a finishing process executed on the paper. Such damage can result in losing the information stored in the IC tag, so that it may make it impossible to search or manage the information using the IC tag.

OBJECTS AND SUMMARY

It is an object of the present invention to provide a processing or finishing device or an image forming device and method of using the same, which are improved for solving the abovementioned problems.

It is another object of the present invention to provide a processing or finishing device or an image forming device and method using the same, which are capable of preventing an IC tag provided on a recording medium from being damaged inadvertently during a finishing process.

According to an embodiment of the invention a processing or finishing device comprises a job receiving unit for receiving a job for processing a recording medium provided with an electronic tag capable of storing electronic data; and an electronic tag location identifying unit for identifying a location of an electronic tag on the recording medium.

According to another embodiment of the invention, there is provided an image forming device, comprising: a job receiving unit for receiving a printing job; a judging unit for judging whether any finishing instruction is included or not in the received printing job for instructing a finishing process to be applied to a printed recording medium; a finishing location identifying unit for identifying a location where the finishing process is to be executed on the recording medium, when a finishing instruction is included in the received printing job; an electronic tag location identifying unit for identifying a location of an electronic tag on the recording medium provided with the electronic tag capable of storing electronic data, when a finishing instruction is included in the received printing job; a comparing unit for comparing the location where the finishing process is to be executed, which is identified by said finishing location identifying unit, and the location of the electronic tag identified by said electronic tag location identifying unit; and a notifying unit for notifying that the location where the finishing process is to be executed matches with the location of the electronic tag when both of the locations match with each other as a result of the comparison by said comparing unit.

According to an embodiment, an electronic tag, such as an IC tag, provided on a recording medium can be prevented from being inadvertently damaged by a finishing process. This prevents the IC tag from losing information stored in it and becoming unable to be searched or managed using the IC tag.

According to another embodiment of the invention, there is provided an image forming device, comprising: a job receiving unit for receiving a printing job; a judging unit for judging whether any finishing instruction is included or not in the received printing job for instructing a finishing process to be applied to a printed recording medium; a finishing location identifying unit for identifying a location where the finishing process is to be executed on the recording medium, when a finishing instruction is included in the received printing job; an electronic tag location identifying unit for identifying a location of an electronic tag on the recording medium provided with the electronic tag capable of storing electronic data, when a finishing instruction is included in the received printing job; a comparing unit for comparing the location where the finishing process is to be executed, which is identified by said finishing position identifying unit, and the location of the electronic tag identified by said electronic tag location identifying unit; and a finishing process prohibiting unit for prohibiting the execution of the finishing process on the recording medium provided with said electronic tag, when the location where the finishing process is to be executed matches with the location of the electronic tag as a result of the comparison by said comparing unit.

According to still another embodiment of the invention, there is provided an image forming method comprising the steps of: 1) accepting a printing job; 2) judging whether any finishing instruction is included or not in the received printing job for instructing a finishing process to be applied to a printed recording medium; 3) identifying a location where the finishing process is to be executed on the recording medium, when a finishing instruction is included in the received printing job; 4) identifying a location of an electronic tag on the recording medium provided with the electronic tag capable of storing electronic data, when a finishing instruction is included in the received printing job; 5) comparing the location where the finishing process is to be executed, which is identified in the step 3), and the location of the electronic tag identified in the step 4); and 6) notifying that the location where the finishing processes is to be executed matches with the location of the electronic tag when both of the locations match with each other as a result of the comparison in the step 5).

The objects, characteristics and properties of this invention other than those set forth above will become apparent from the description given herein below with reference to preferred embodiments illustrated in the accompanying drawings.

BRIEF DESCRIPTION OF THE DRAWINGS

FIG. 4 is a diagram for describing the contents of the electronic data stored in the IC tag.

FIG. 7 is a diagram showing an example of printing job information.

FIG. 8 shows an example of finishing information table.

DETAILED DESCRIPTION OF PREFERRED EMBODIMENTS

The embodiments of this invention will be described below with reference to the accompanying drawings.

Figure 1:
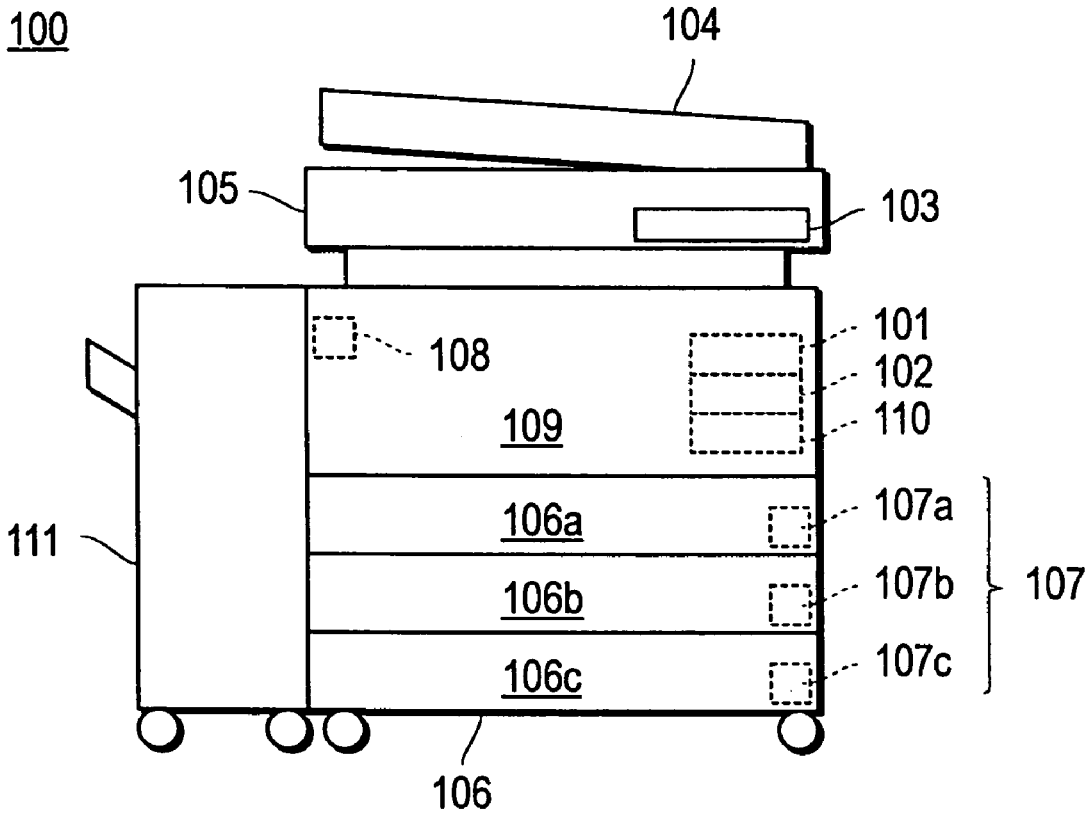
FIG. 1 is a schematic front view showing the constitution of a multi-function peripheral (MFP) provided as an image forming device according to an embodiment of the present invention.
Figure 2:
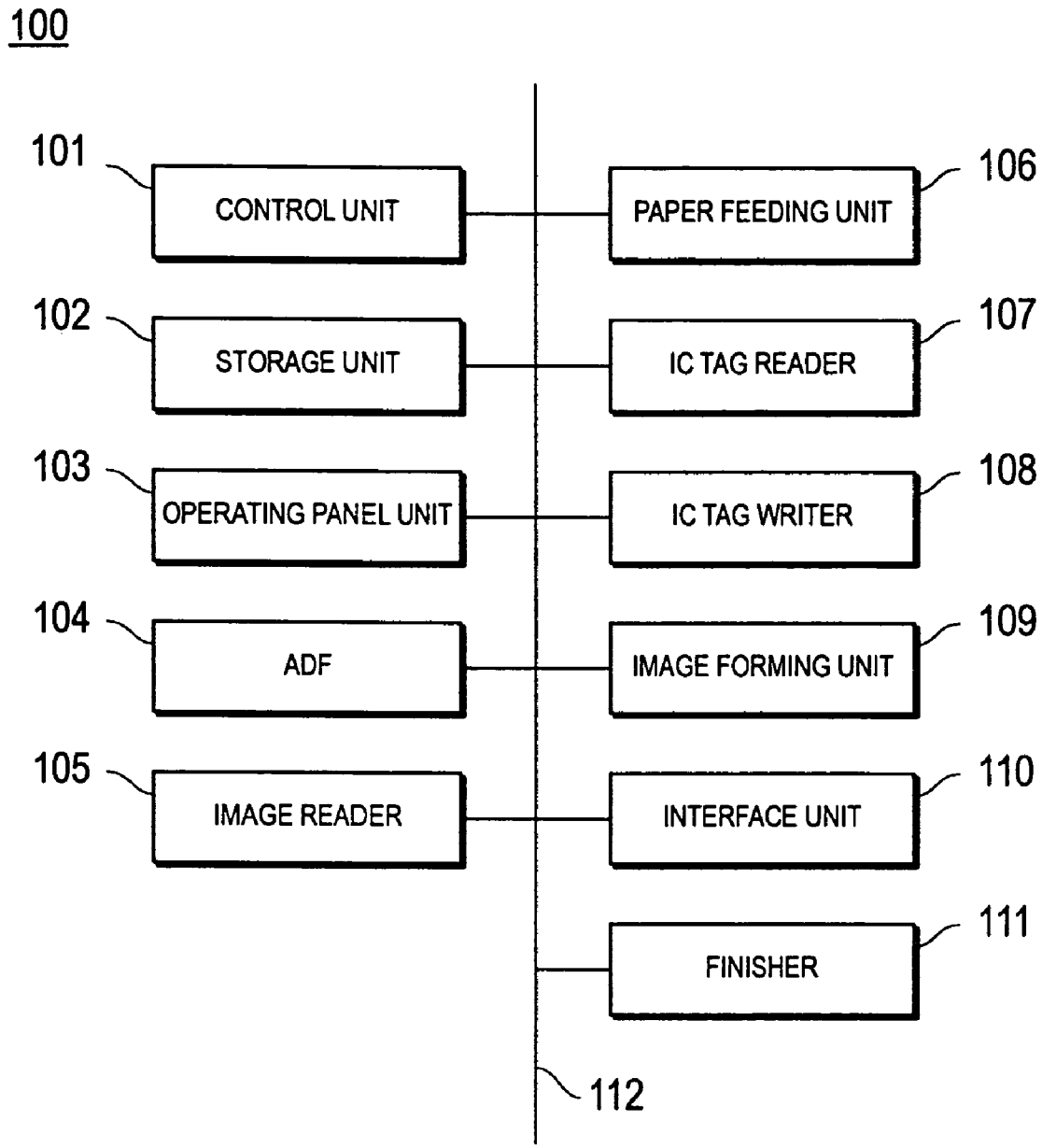
FIG. 2 is a block diagram showing the constitution of the MFP shown in FIG. 1.

FIG. 1 is a general front view showing the constitution of an MFP (Multi-Function Peripheral) provided as an image forming device according to an embodiment of the present invention and FIG. 2 is a block diagram showing the constitution of the MFP shown in FIG. 1.

The MFP 100 is equipped with a control unit 101, a storage unit 102, an operating panel unit 103, an ADF (Auto Document Feeder) 104, an image reader 105, a paper feeding unit 106, an IC tag reader 107, an IC tag writer 108, an image forming unit 109, an interface unit 110, and a finisher 111, all of which are interconnected via a bus 112 for exchanging signals with each other.

The control unit 101 includes a CPU, and controls various parts indicated above and executes various arithmetic processes according to a program. The storage unit 102 consists of a ROM for storing various programs and data, a RAM for temporarily storing programs and data as a working area, a hard disk for storing various programs and data including an operating system, etc.

The operating panel 103 is equipped with a touch panel, a ten-key pad, a start button, a stop button and others to be used for displaying various kinds of information and entering various instructions.

The ADF 104 transports a single or multiple sheets of paper one sheet at a time to a specified reading position of the image reader 105, and discharges the document sequentially after reading it.

The image reader 105 irradiates a document set on the specified scanning location or transported to the specified reading position by the ADF with a light source such as a fluorescent lamp and the like, converts reflected lights from the document surface into electrical signals with the help of light sensitive devices such as a CCD image sensor, and generates image data from the electrical signals.

The paper feeding units 106*a* through 106*c* contain paper as recording media to be used in the printing process. The paper feeding unit 106 (a group name for 106*a* through 106*c*) feeds the contained paper to the image forming unit 109 one sheet at a time.

The IC tag readers 107*a* through 107*c* are provided in the vicinity of the paper feeding units 106*a* through 106*c* respectively. The IC tag reader 107 (a group name for 107*a* through 107*c*) reads electronic data stored in the IC tag of the paper provided with an IC tag ("IC-tagged paper") to be described later. The IC tag reader 107 can read the entire electronic data stored in the IC tag reader or read the data by each specified unit depending on the instruction of the control unit 101. As the communication system between the IC tag reader 107 and the IC tag, those of the international standards such as ISO 14443 and ISO 15693 can be applied using frequency bands such as 135 kHz, 13.56 MHz, and 2.45 GHz. The normally used frequency band is 13.56 MHz and the communication range is approximately 30 cm when said frequency band is used. However, the communication systems that can be applied are not limited to those mentioned above, and other known communication systems or proprietary communication systems may be used.

The IC tag reader 107 can detect whether an IC tag is provided or not on the paper contained in the paper feeding unit 106. For example, the presence of an IC tag in the paper can be detected, for example, by transmitting a radio wave from the IC tag reader 107 and checking if the radio wave is transmitted back from the IC tag to the IC tag reader 107. The method of detecting the presence of an IC tag in the paper is not limited to the method described above, and other detection methods can be used as well. The presence of an IC tag in the paper can be detected immediately before reading the electronic data in the IC tag, when setting the paper to the paper feeding unit 106, when starting up the MFP 100, or at a specified interval. However, the procedure conducted for IC-tagged paper will be described below.

The IC tag writer 108 is used to write electronic data on the IC tag on the IC-tagged paper to be described later. The IC tag writer 108 can be an identical unit as the IC tag reader 107, and the communication system between the IC tag writer 108 and the IC tag can be the same as that of the IC tag reader 107.

The image forming unit 109 prints various data on paper using a known imaging process such as the electronic photographing process including such processes as electrical charging, exposure, developing, transferring and fixing.

The interface unit 110 is an interface for communicating with external equipment, and network interfaces such as Ethernet®, Token Ring, and FDDI standards, serial interfaces such as USB and IEEE 1394, parallel interfaces such as SCSI and IEEE 1284, wireless communication interfaces such as Bluetooth®, IEEE 802.11, HomeRF®, and IrDA®, as well as telephone circuit interfaces for connection to telephone circuits can be used.

The finisher 111 conducts a finishing process to be applied to the printed paper transferred from the image forming unit 109. The finishing process includes the stapling process for stapling the paper bundle, the punching process for punching holes for filing on the edge of the paper, the folding process for folding the paper, and the trimming process for cutting off the edge of the paper.

The MFP 100 has the printing function for printing according to an instruction from an external device such as a PC (personal computer) or a portable terminal, and the copying function for copying documents.

The MFP 100 can have components other than those described above or can lack a portion of those components described above.

Next, the IC-tagged paper according to the present embodiment will be described.

Figure 3:
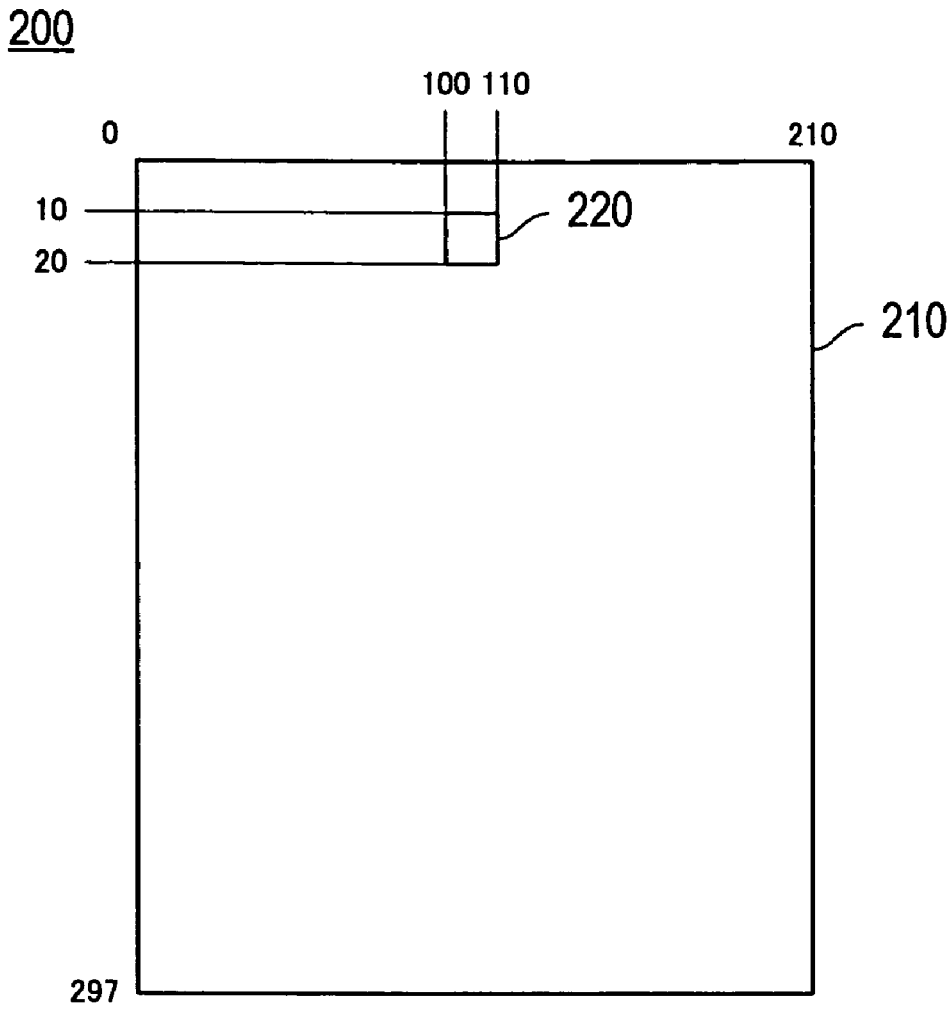
FIG. 3 is a schematic diagram showing a constitution of IC-tagged paper.

FIG. 3 is a schematic diagram showing a constitution of IC-tagged paper 200. The IC-tagged paper 200 is provided with an IC tag 220 at least in a portion of paper 210. The IC tag 220 can be glued on to the paper 210 or embedded in the paper 210. There can be a single IC tag or a multiplicity of IC tags 220 on a single sheet of paper 210.

The IC tag 220 is a non-contacting type electronic tag using wireless communication and contains a memory part consisting of an IC chip and an antenna part consisting of a coil (neither of them shown) in the inside. The IC tag 220 receives radio waves emitted from the IC tag reader 107 or the IC tag writer 108 to conduct wireless communications with the IC tag reader 107 or the IC tag writer 108 by means of electromagnetic induction coupling and allows reading and writing of electronic data.

FIG. 4 is a diagram for describing the contents of the electronic data stored in the IC tag 220. The electronic data 300 is stored in the memory part of the IC tag 220. The electronic data 300 is described in the XML format and contains IC tag information 310 and paper information 320.

The IC tag information 310 consists of information concerning presence or absence of an IC tag, serial number of an IC tag, location of an IC tag on a sheet of paper, etc. The IC tag information 310 is fixed that cannot be modified by the user. The location of an IC tag on a sheet of paper is given by its coordinate values (unit: e.g., mm) on the orthogonal coordinate system having its origin at the top left corner of the paper (see FIG. 3 and FIG. 4). More specifically, the location of the IC tag 220 is defined by the coordinates of the top left and the right bottom corners of a circumscribing rectangle of the IC tag 220.

The paper information 320 contains the paper's attributive information that cannot be normally modified by the user and the information concerning the printing contents on the paper to be written when the paper is printed. The attributive information of the paper includes the size and type of the paper. The information concerning the printing contents on the paper includes the page number, the size (largeness) of image to be printed on the paper, and the color of the image. The information concerning the printing contents on the paper can include the image to be printed or data that corresponds to said image. Incidentally, the contents of the information stored in the IC tag 220 as electronic data and the format of the electronic data are not limited to those examples.

The operation of the MFP in this embodiment will be described in the following.

Figure 5:
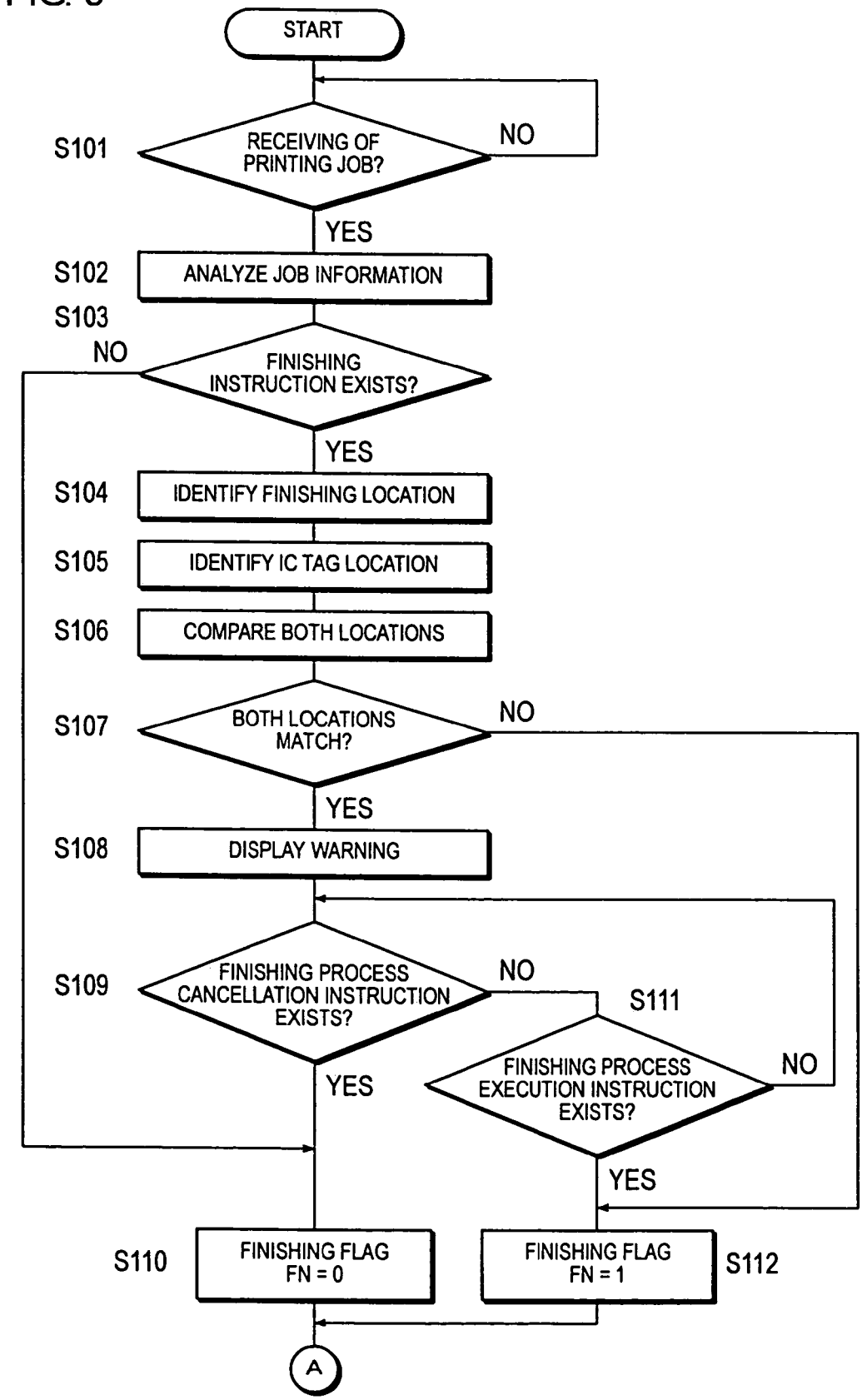
FIG. 5 is a flowchart showing the printing process procedure on the MFP.
Figure 6:
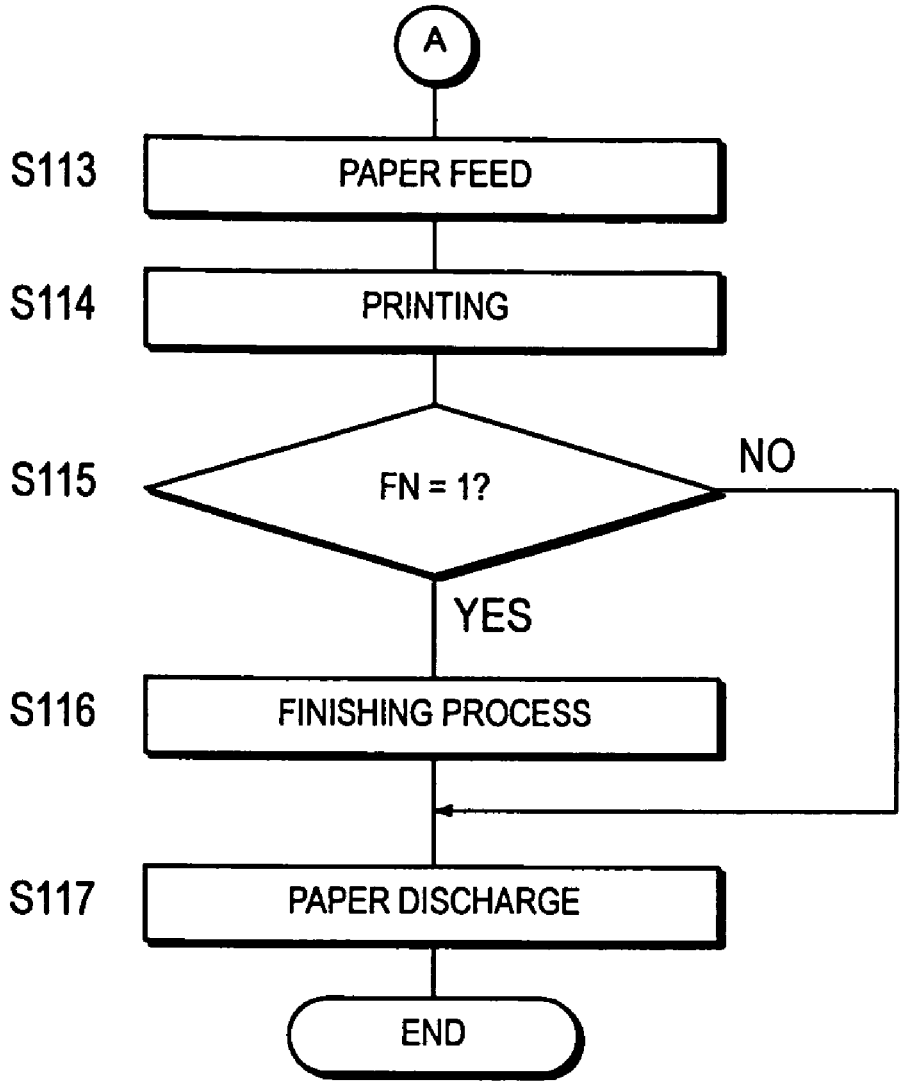
FIG. 6 is a flowchart showing the printing process procedure on the MFP continued from FIG. 5.

FIG. 5 and FIG. 6 represent a flowchart showing the printing process procedure on the MFP 100. The algorithm shown in the flowchart of FIGS. 5 and 6 is stored as a program in the storage unit 102 of the MFP 100 and executed by the control unit 101.

First, MFP 100 waits until the printing job is received (S101: No). The printing job herein includes both a job relating to printing based on the data obtained by reading a document using the copying function, and a job relating to printing based on the data received via the interface unit 110 using the printing function.

The printing job consists of printing job information concerning a printing job and image data, which is the object of the printing, consisting of, for example, four-color data of C (cyan), Y (yellow), M (magenta), and K (black). FIG. 7 shows an example of printing job information. The printing job information 400 contains job information 401, which is the information for the entire printing job, and page information 402, which is the information for a particular page.

When a printing job is received (S101: Yes), the printing job information 400 contained in the received printing job is analyzed (S102).

Next, a judgment is made as to whether any finishing instruction is included for instructing a finishing process in the job information 401 of the printing job information 400 (S103) More specifically, a judgment is made, for example, if any values (parameters) exist in the "stapling process," "punching process," "folding process," and "trimming process" items of the job information 401 (see FIG. 7). If no finishing instruction is included in the printing job information 400 (S103: No), the process advances to the step S110.

On the other hand, if there is a finishing instruction included in the printing job information 400 (S103: Yes), a recognition process for the finishing location is executed in order to identify the location on the paper where a particular finishing process is to be executed (S104).

More specifically, the finishing information table stored in the storage unit 102 is referenced first. FIG. 8 shows an example of finishing information table. The finishing information table 500 is a table that shows the types of finishing processes that are executable by the finisher 111 and the finishing location in each finishing process.

Figure 9:
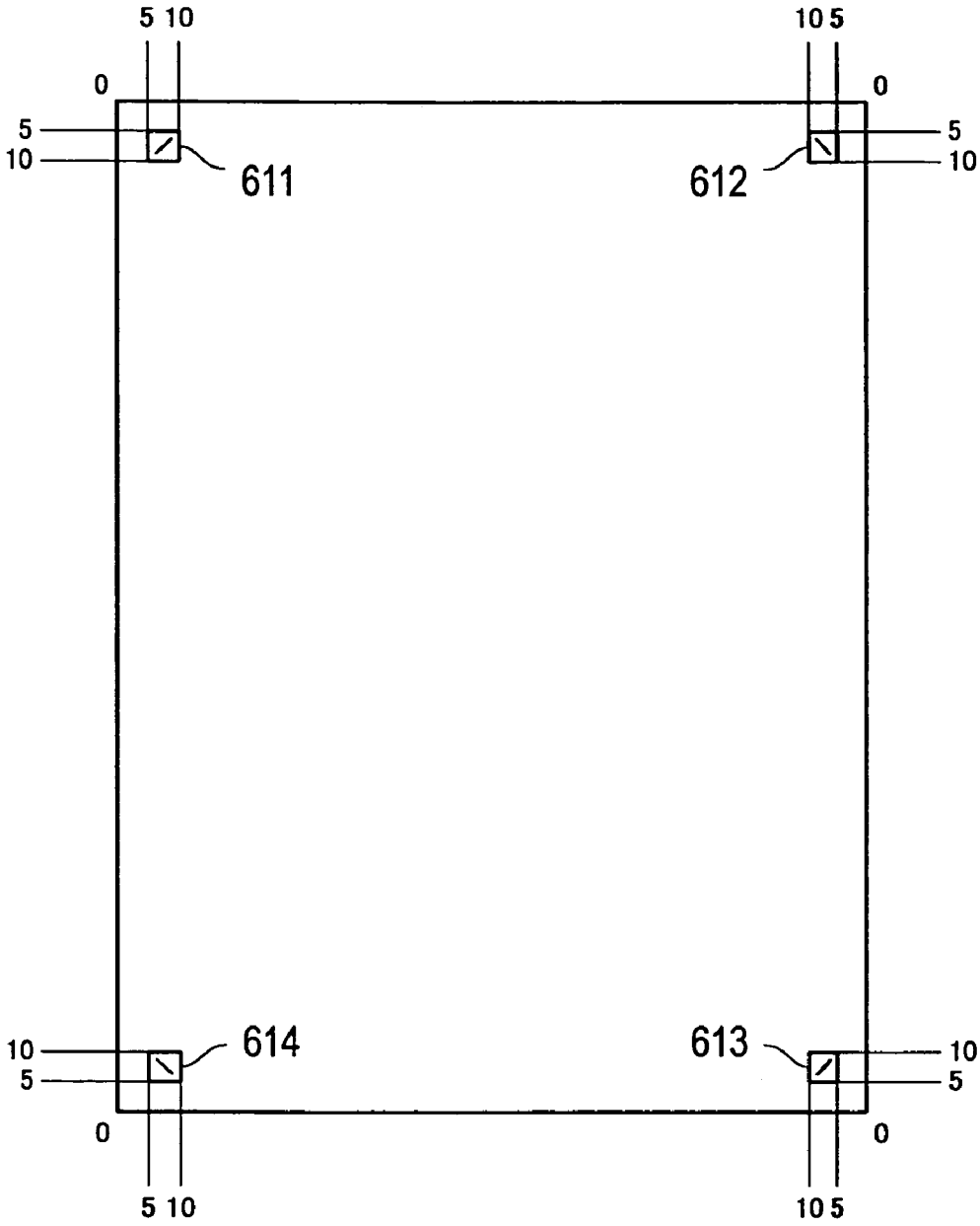
FIG. 9 is a diagram showing the finishing location where a corner stapling is specified in the stapling process.
Figure 10:
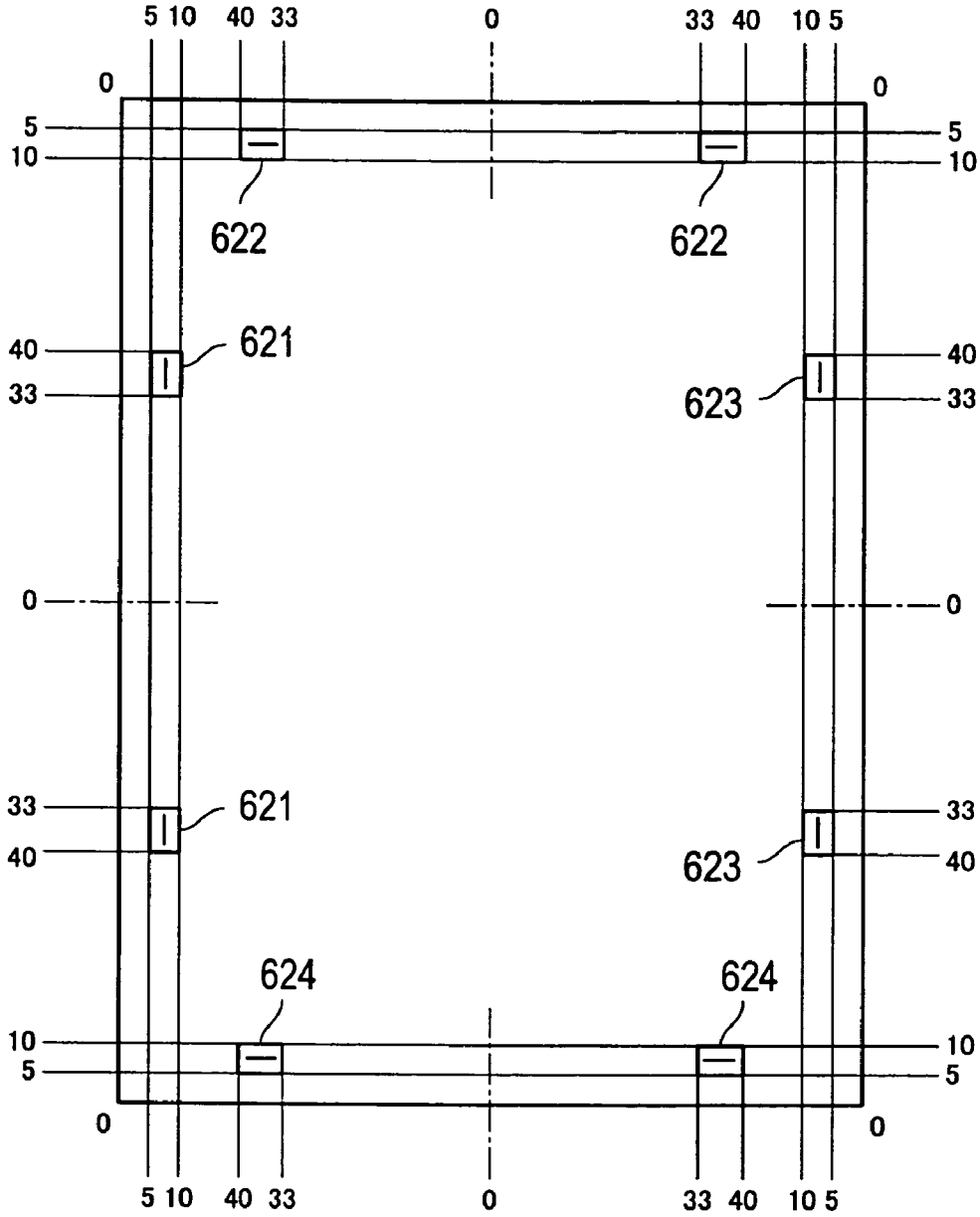
FIG. 10 is a diagram showing the finishing location where a two-point side stapling is specified in the stapling process.
Figure 11:
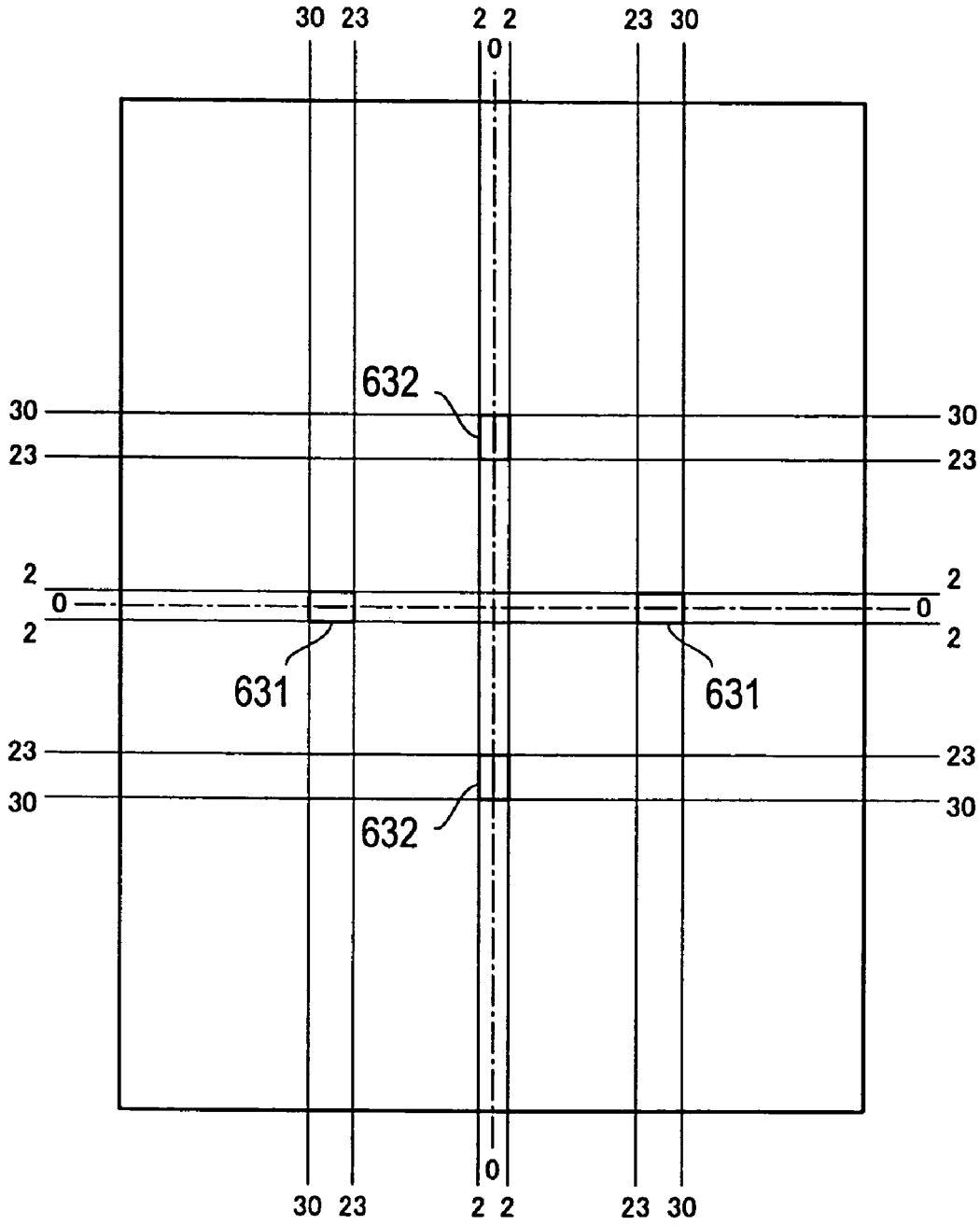
FIG. 11 is a diagram showing the finishing location where a two-point center stapling is specified in the stapling process.

FIG. 9 through FIG. 11 are diagrams showing the finishing location where stapling process is executed. If a corner stapling is specified in the stapling process, the finishing location has areas 611 through 614 shown in FIG. 9 (four patterns). If a two-point side stapling is specified in the stapling process, the finishing location has areas 621 through 624 shown in FIG. 10 (four patterns). If a two-point center stapling is specified in the stapling process, the finishing location has areas 631 and 632 shown in FIG. 11 (two patterns). The line segments shown in each area of FIG. 9 through FIG. 11 represent staples.

Figure 12:
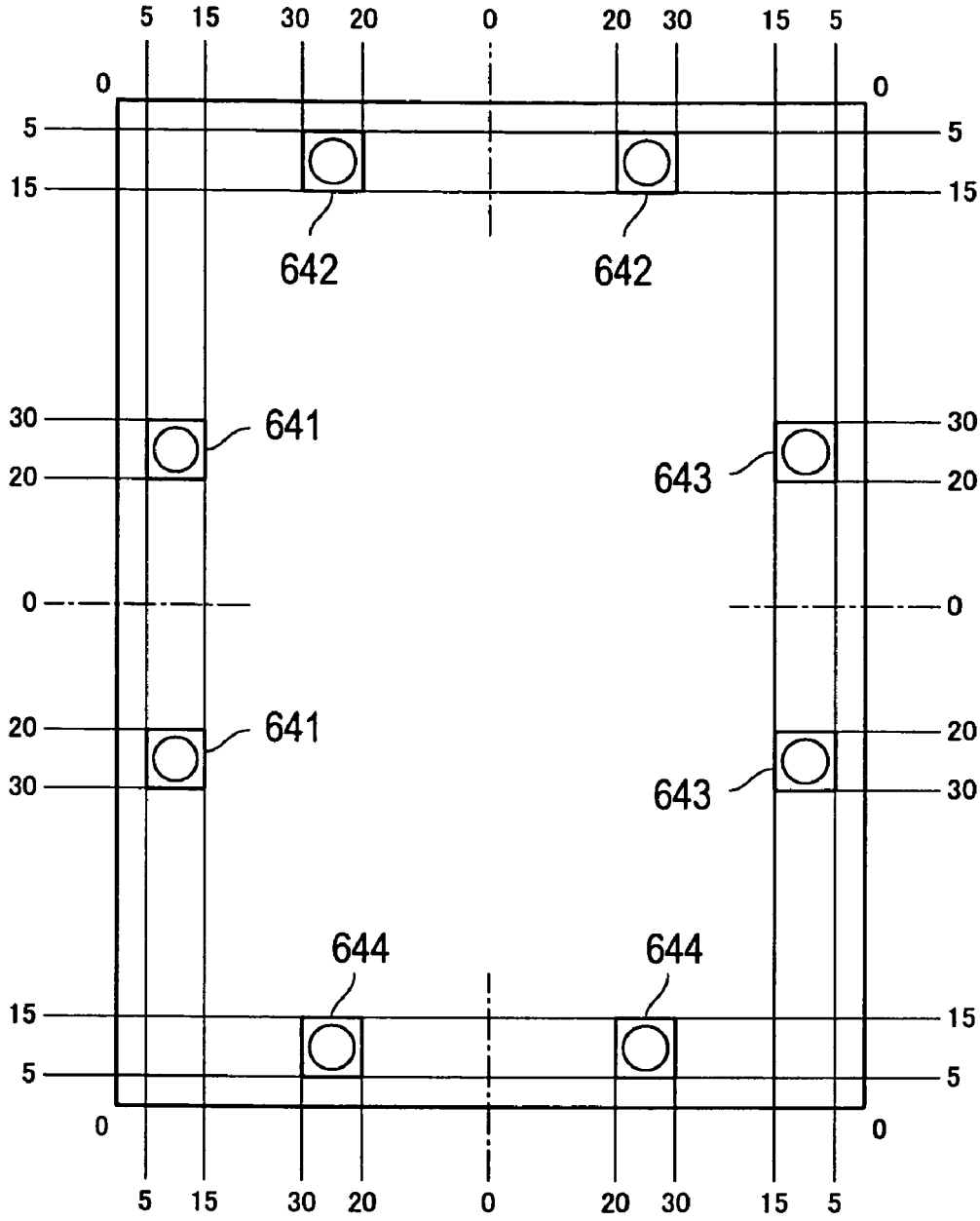
FIG. 12 is a diagram showing the finishing location where a two-point side punching is specified in the punching process.
Figure 13:
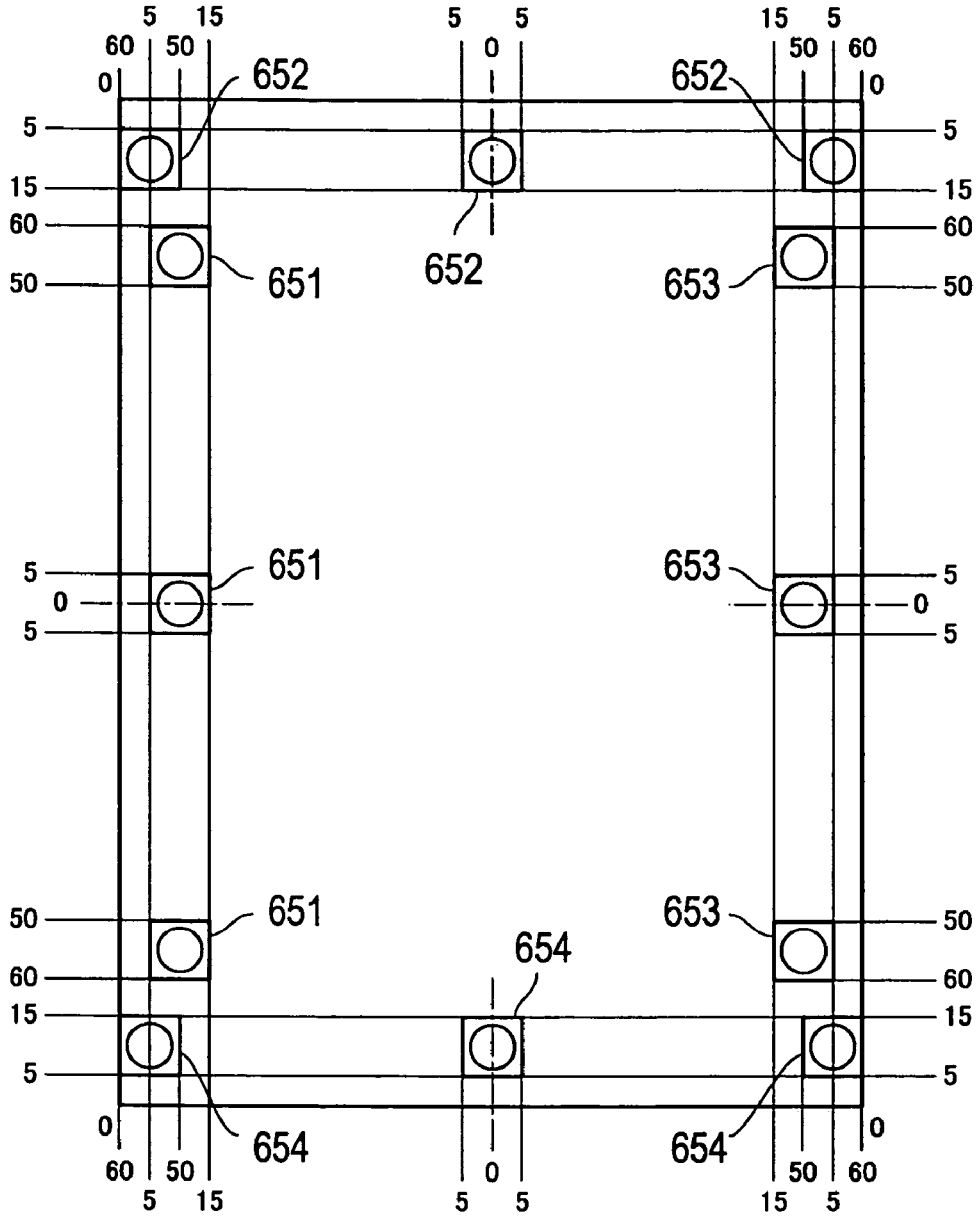
FIG. 13 is a diagram showing the finishing location where a three-point side punching is specified in the punching process.

FIG. 12 and FIG. 13 are diagrams showing the finishing location where punching process is executed. If a two-point side punching is specified in the punching process, the finishing location has areas 641 through 644 shown in FIG. 12 (four patterns). If a three-point side punching is specified in the punching process, the finishing location has areas 651 through 654 shown in FIG. 13 (four patterns). The circles shown in each area of FIG. 12 and FIG. 13 represent punched holes.

Figure 14:
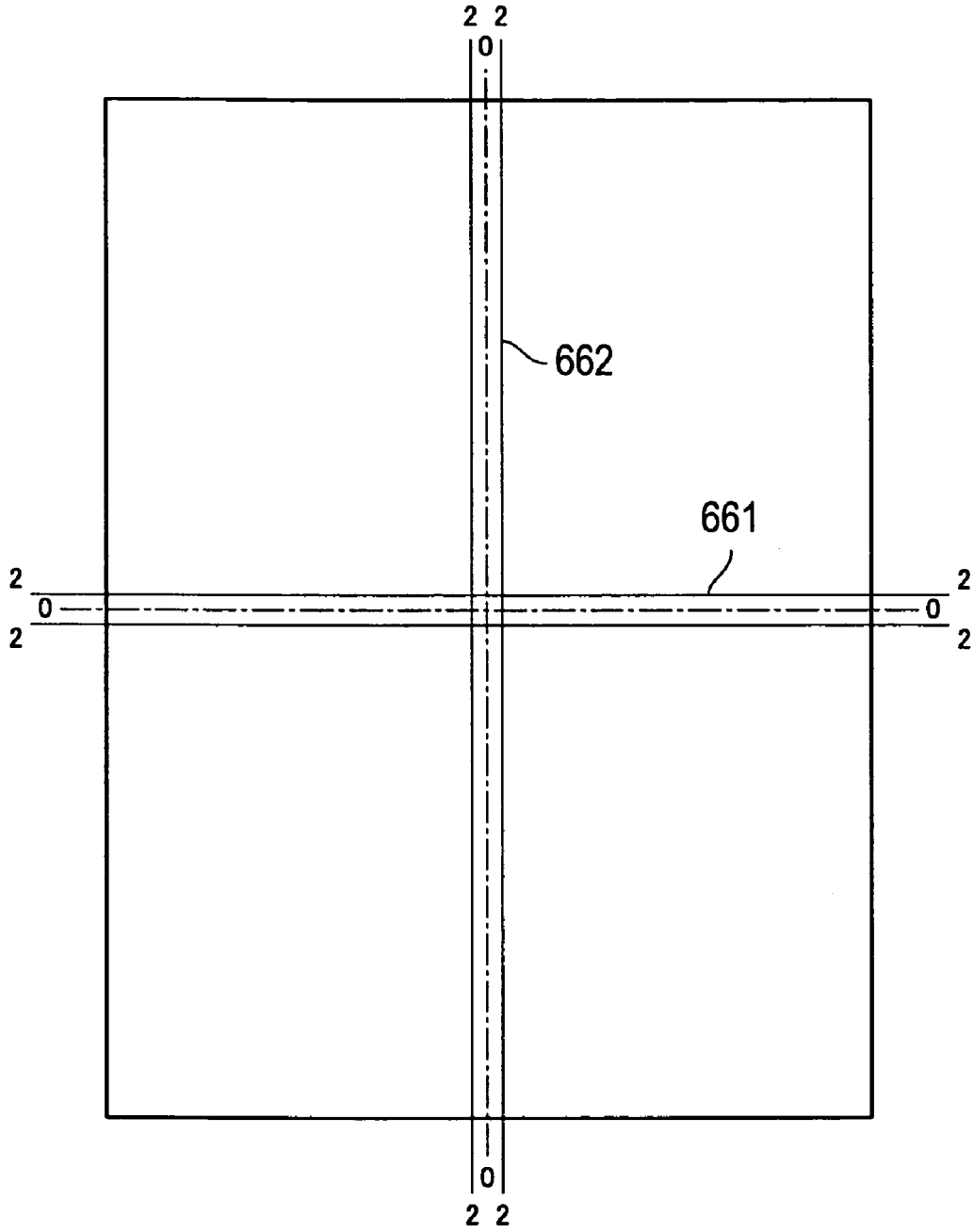
FIG. 14 is a diagram showing the finishing location where center folding is specified in the folding process.
Figure 15:
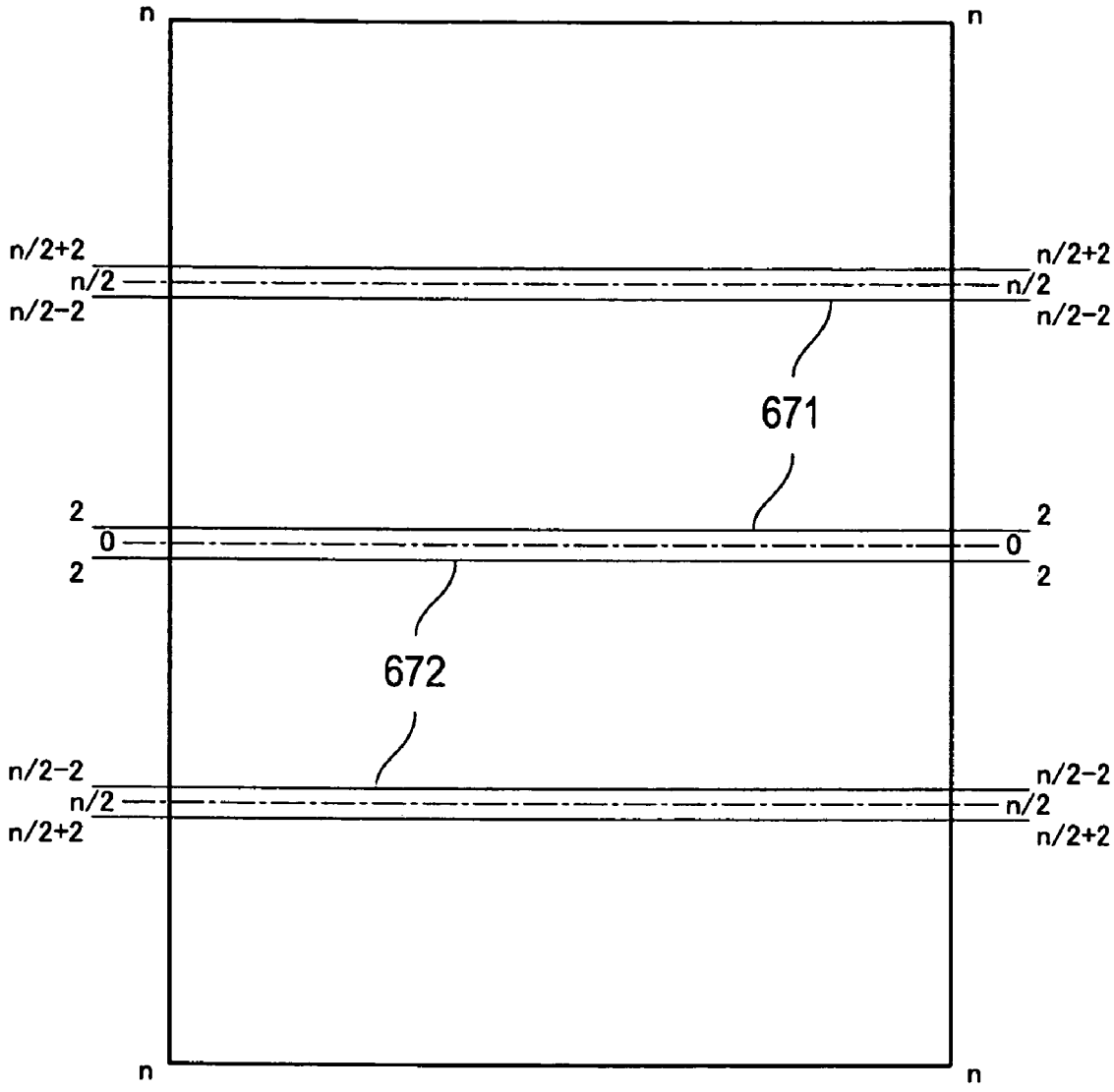
FIG. 15 is a diagram showing the finishing location where Z-folding is specified in the folding process.

FIG. 14 and FIG. 15 are diagrams showing the finishing location where folding process is executed. If a center folding is specified in the folding process, the finishing location has areas 661 and 662 shown in FIG. 14 (two patterns). Center folding is a folding process in which a crease is formed in the center of a sheet of paper. If a Z-folding is specified in the folding process, the finishing location has areas 671 and 672 shown in FIG. 15 (two patterns). Z-folding is a folding process in which a sheet of paper is folded like a letter Z so that the size of the folded paper is reduced to about a half of its length along the direction of transfer of the paper. The chain lines shown in each area of FIG. 14 and FIG. 15 correspond to the folding lines.

Figure 16:
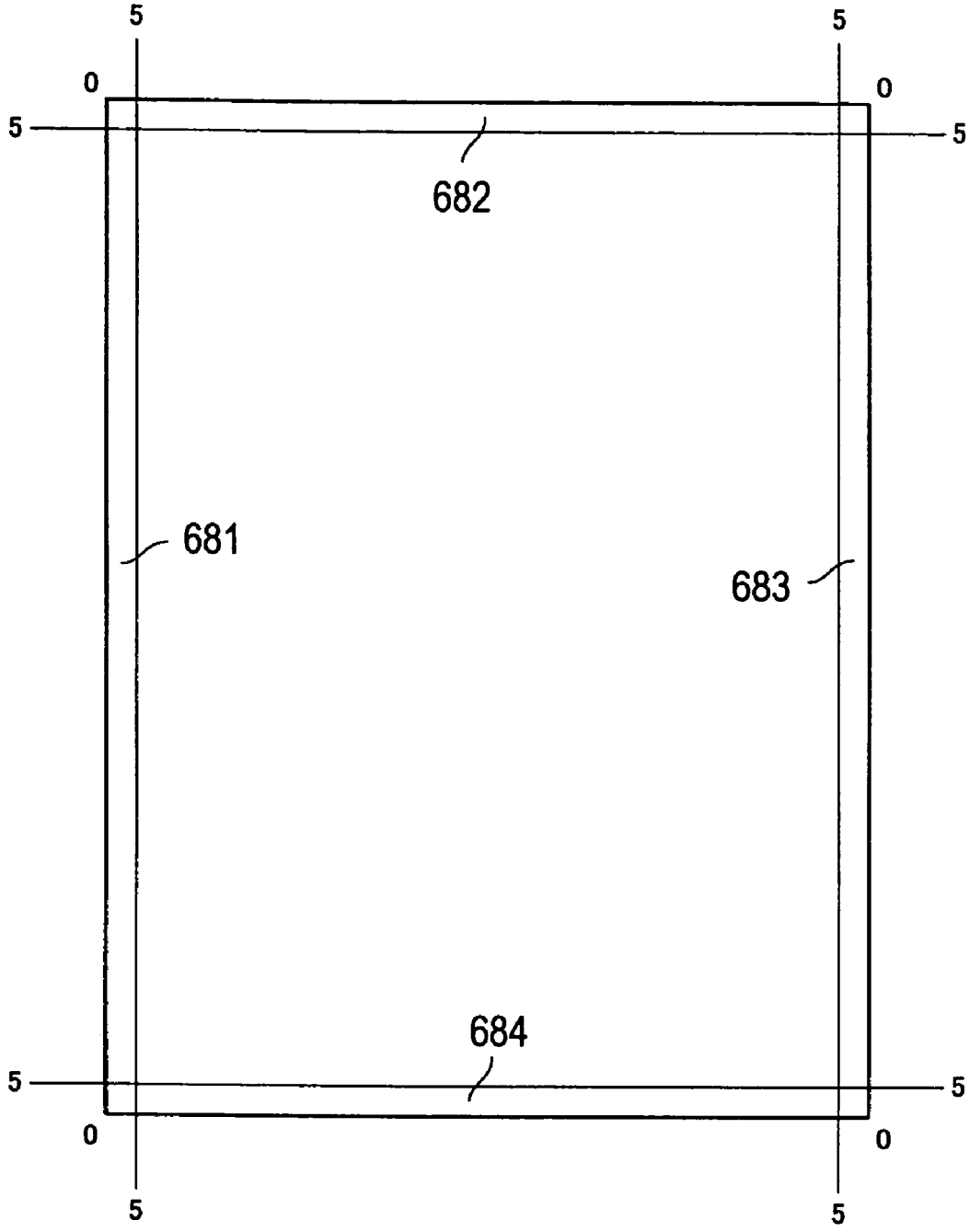
FIG. 16 is a diagram showing the finishing location where trimming is executed.

FIG. 16 is a diagram showing the finishing location where trimming process is executed. If a trimming process is to be executed, the finishing location has areas 681 through 684 shown in FIG. 16 (four patterns).

In FIG. 9 and FIG. 16, the finishing location on the paper is indicated by coordinates (positive values) on an orthogonal coordinate system having the corner of the paper which is closest to a particular finishing area as the origin respectively for convenience sake. In FIG. 10, FIG. 12, and FIG. 13, the finishing location on the paper is indicated by coordinates (positive values) on an orthogonal coordinate system having the middle point of a side of the paper which is closest to a particular finishing area as the origin respectively for convenience sake. In FIG. 11, FIG. 14, and FIG. 15, the finishing location on the paper is indicated by coordinates (positive values) on an orthogonal coordinate system having the center of the paper as the origin respectively for convenience sake.

Getting back to the description of FIG. 5, the finishing location that corresponds to the finishing instruction of the printing job information 400 is identified referencing the finishing information table 500 in the step S104. For example, in analyzing the printing job information 400 shown in FIG. 7, the areas 631 and 632 of FIG. 11 and the areas 661 and 662 of FIG. 14 are identified as the finishing location since the two-point center stapling and the center folding are specified.

Next, the location of the IC tag 220 on the paper 210 is identified (SLOS). More specifically, the IC tag reader 107 provided on the paper feeding unit 106 to be used as specified in the printing job reads the IC tag information 310 stored in the IC tag 220 of the IC-tagged paper 200 contained in the paper feeding unit 106 to be used. The obtained IC tag information 310 is temporarily held in the storage unit 102. The IC tag location is identified from the IC tag information 310. The order of execution of the steps S104 and S105 can be reversed.

The paper feeding unit 106 to be used is identified as the value of the "paper feeding tray" in the page information 402 included in the printing information 400. When the value of the "paper feeding tray" is "automatic selection," the paper feeding tray, in which the paper corresponding to the values of the "paper size" and the "paper type" found in said page information is contained, will be selected.

Next, the finishing location identified in the step S104 and the IC tag location identified in the step S105 are compared to each other (S106).

A judgment is made as to whether the finishing location matches or not with the IC tag location based on the result of comparison in the step S106 (S107). If the IC tag location matches with the finishing location at least partially, it is judged that both locations match with each other. If the positioning mode for the paper in the paper feeding unit 106 is unilaterally defined (whether the paper is to be set correctly in terms of the front and back sides and its orientation), the finishing location is to be determined to either one of the areas shown in FIG. 8 through FIG. 15. If the two locations do not match (S107: No), the process advances to step S112.

If the two locations match (S107: Yes), a warning to indicate the matching of the two locations will be displayed on the operating panel unit 103 (S108).

Figure 17:
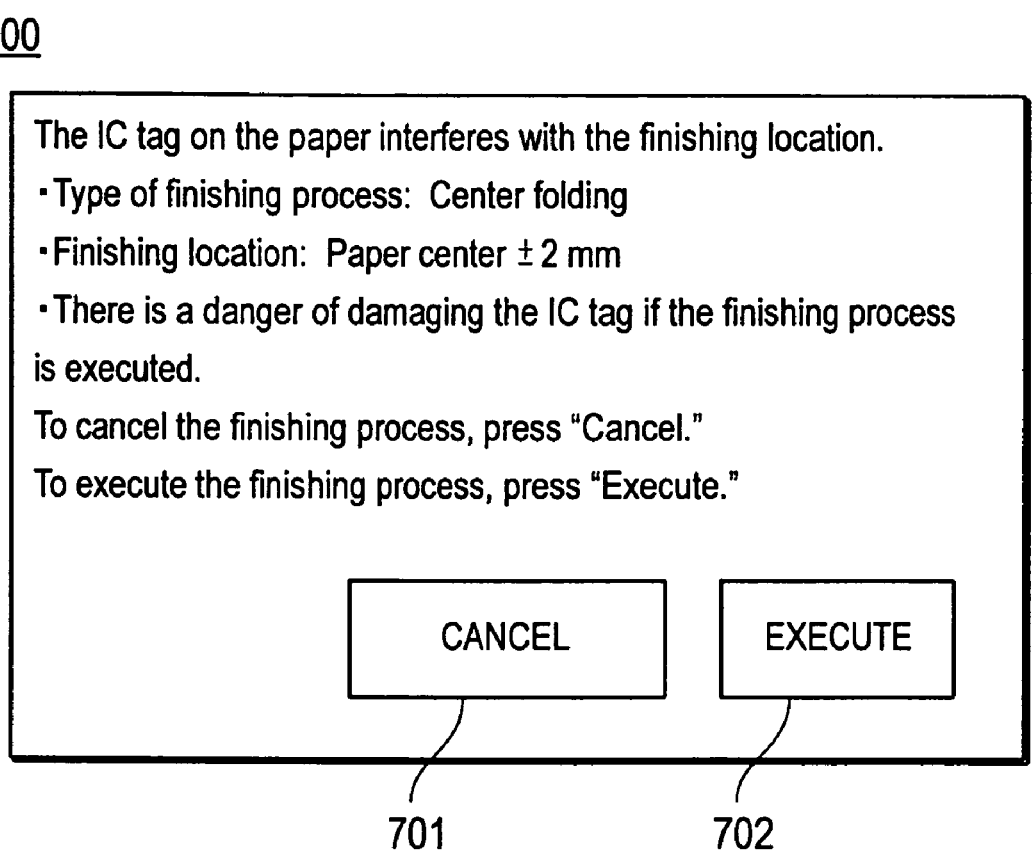
FIG. 17 is a diagram showing an example of a warning screen.

FIG. 17 is a diagram showing an example of a warning screen. The warning screen 700 includes a warning message that the IC tag 220 exists in the finishing location and that there is a risk of damaging the IC tag 220 if the finishing process is executed. The warning screen 700 includes a canceling button 701 for canceling the finishing process and an execution button 702 for executing the finishing process and a prompting display is made prompting the operator to select one of the buttons.

A judgment is made as to whether a cancellation instruction is issued by means of pressing the canceling button 701 or not for canceling the finishing process (S109). If a cancellation instruction exists (S109: Yes), the program advances to step S110. If no cancellation instruction exists (S109: No), a judgment is made as to whether an execution instruction is issued by means of pressing the execution button 702 or not for executing the finishing process (S111). If an execution instruction exists (S111: Yes), the program advances to step S112. On the other hand, if no execution instruction exists (S111: No), the program returns to the step S109.

In the step S110, the value "0" is set to the finishing flag FN to indicate that the finishing process is not executed. On the other hand, in the step S112, the value "1" is set to the finishing flag FN to indicate that the finishing process is executed. The set value of the finishing flag FN is held in the storage unit 102.

After the finishing flag FN is set, a sheet of paper will be picked up from the paper feeding unit 106, which is specified to be used in the printing job, and is fed to the image forming unit 109 (S113).

Next, the specified image data is printed on the paper fed from the paper feeding unit 106 (S114). The printed paper is transferred to the finisher 111. The IC tag writer 108 may write the specified electronic data on the IC tag on the paper at this point.

The control unit 101 makes a judgment as to whether the finishing flag FN held in the storage unit 102 is set to "1" or not (S115).

If the finishing flag FN is "1" (S115: Yes), the printed paper will be applied with the specified finishing process corresponding with the finishing instruction of the printing job information 400 (S116), and the paper will be discharged (S117).

On the other hand, if the finishing flag FN is "0" (S115: No), the printed paper will be discharge without being applied with the finishing process (S117).

As can be seen from the present embodiment, the MFP 100 identifies the finishing location on the paper and also identifies the IC tag location on the paper when a finishing instruction is included in a received printing job. Moreover, when the finishing location matches with the IC tag location, the MFP 100 notifies the user that both of the locations match with each other.

Therefore, the user can choose whether to execute the finishing process or not, so that it is possible to prevent the IC tag provided on the paper from being inadvertently damaged by the finishing process. This prevents the IC tag from losing information stored in it and becoming unable to be searched or managed using the IC tag.

It is obvious that this invention is not limited to the particular embodiments shown and described above but may be variously changed and modified without departing from the technical concept of this invention.

For example, although it is constituted in the above embodiment in such a way that the system notifies the user the fact that the finishing location matches with the IC tag location when the two locations match with each other, thus prompting the user to decide whether to execute the finishing process or not, the invention is not limited to such a constitution. It can be so constituted in this invention to prohibit the execution of the finishing process on a sheet of paper provided with an IC tag, if the finishing location matches with the IC tag location.

Also, although the above embodiment is constituted in such a way that the electronic data stored in the IC tag provided on the paper is read and the IC tag location on the paper is identified from said electronic data, the invention is not limited to it. The IC tag location on the paper can be identified by physically detecting the IC tag itself by a detector such as an optical sensor provided in the vicinity of the paper feeding unit 106 in the MFP 100 or on the paper transfer passage.

For example, although an MFP is mentioned as the image forming device in the above embodiment, the image forming device of the present invention is not limited to it and other devices such as a printer, a copying machine, or a finisher therefore can be used for the same purpose. Furthermore, electronic tags other than IC tag may be utilized according to the present invention.

The means and method of conducting various processes in the image forming device according to the present invention can be realized by means of a dedicated hardware circuit, or a programmed computer. Said program can be provided either by a computer readable recording medium such as a flexible disk and a CD-ROM, or by being supplied on-line via a network such as the Internet. In this case, the program recorded on the computer readable recording medium is normally transferred to and stored in a storage unit such as a hard disk. Said program can also be provided as independent application software or can be built into the software of the image processing device as a part of its function.

The foregoing has described principles, preferred embodiments and modes of operation of the invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the invention as defined by the following claims and equivalents thereof.

What is claimed is:

1. A recording medium processing device, comprising:

a job receiving unit for receiving a job for processing a recording medium provided with an electronic tag capable of storing electronic data; and an electronic tag location identifying unit for identifying a location of the electronic tag on the recording medium.

2. A recording medium processing device as claimed in claim 1, further comprising:

a judging unit for judging whether a finishing instruction for instructing a finishing process to be applied to the recording medium is included in the received job or not.

3. A recording medium processing device as claimed in claim 2, wherein the electronic tag location identifying unit identifies the location of an electronic tag when the judgment unit judges the finishing instruction is included in the received job.

4. A recording medium processing device as claimed in claim 1, further comprising:

a finishing location identifying unit for identifying a location where a finishing process is to be executed on the recording medium; and a comparing unit for comparing the location where the finishing process is to be executed, which is identified by said finishing location identifying unit, and the location of the electronic tag identified by the electronic tag location identifying unit.

5. A recording medium processing device as claimed in claim 4, further comprising:

a notifying unit for notifying that the location where the finishing process is to be executed overlaps with the location of the electronic tag in accordance with a result of the comparison by the comparing unit.

6. A recording medium processing device as claimed in claim 4, further comprising:

a finishing prohibiting unit for prohibiting the execution of the finishing process in accordance with a result of the comparison by the comparing unit.

7. An image forming device as claimed in claim 1, wherein the electronic tag location identifying unit identifies the location of the electronic tag on the recording medium from the electronic data stored in the electronic tag provided on the recording medium.

8. An image forming device as claimed in claim 4, further comprising:

a selection receiving unit for, after the comparison by the comparing unit, receiving a selection of whether the finishing process is to be executed on the recording medium provided with the electronic tag or not.

9. An image forming device as claimed in claim 2, wherein said finishing process includes at least one of the following processes (1) through (4):

(1) a stapling process for stapling a bundle of recording media that include the recording medium provided with the electronic tag;

(2) a punching process for punching a hole for filing on an edge of the recording medium;

(3) a folding process for folding the recording medium; and (4) a trimming process for cutting off an end of the recording medium.

10. An image forming device, comprising:

a job receiving unit for receiving a job for processing a recording medium provided with the IC tag capable of storing electronic data;

a judging unit for judging whether a finishing instruction for instructing a finishing process to be applied to the recording medium is included in the received job or not;

a finishing location identifying unit for identifying a location where the finishing process is to be executed on the recording medium;

an electronic tag location identifying unit for identifying a location of the electronic tag on the recording medium;

a comparing unit for comparing the location where the finishing process is to be executed, which is identified by said finishing location identifying unit, and the location of the electronic tag identified by said electronic tag location identifying unit.

11. An image forming device as claimed in claim 10, further comprising:

a notifying unit for notifying that the location where the finishing process is to be executed overlaps with the location of the electronic tag in accordance with a result of the comparison by the comparing unit.

12. An image forming device as claimed in claim 10, wherein the electronic tag location identifying unit identifies the location of the electronic tag on the recording medium from the electronic data stored in the electronic tag provided on the recording medium.

13. An image forming device as claimed in claim 10, further comprising:

a selection receiving unit for, after the comparison by the comparing unit, receiving a selection of whether the finishing process is to be executed on the recording medium provided with the electronic tag or not.

14. An image forming device as claimed in claim 10, wherein said finishing process includes at least one of the following processes (1) through (4):

(1) a stapling process for stapling a bundle of recording media that include the recording medium provided with the electronic tag;

(2) a punching process for punching a hole for filing on an edge of the recording medium;

(3) a folding process for folding the recording medium; and (4) a trimming process for cutting off an end of the recording medium.

15. An image forming device as claimed in claim 10, further comprising:

a finishing process prohibiting unit for prohibiting the execution of the finishing process on the recording medium based on a result of the comparison by the comparing unit.

16. A recording medium processing method, comprising the steps of:

1) accepting a job for processing a recording medium provided with an electronic tag capable of storing electronic data; and 2) identifying a location of the electronic tag on the recording medium.

17. A recording medium processing method as claimed in claim 16, further comprising the step of:

3) judging whether a finishing instruction for instructing a finishing process to be applied to the recording medium is included in the received job or not.

18. A recording medium processing method as claimed in claim 16, further comprising the steps of:

4) identifying a location where the finishing process is to be executed on the recording medium;

5) comparing the location where the finishing process is to be executed, which is identified in the step 2), and the location of the electronic tag identified in the step 4).

19. A recording medium processing method as claimed in claim 18, further comprising the step of:

6) notifying that the location where the finishing processes is to be executed matches with the location of the electronic tag based on a result of the comparison in the step 5).

20. A recording medium processing method as claimed in claim 18, further comprising the step of:

7) prohibiting the execution of the finishing process in accordance with a result of the comparison in the step 5).

21. A recording medium processing method as claimed in claim 18, wherein in the step 4), the electronic tag location is identified from the electronic data stored in the electronic tag provided on the recording medium.

22. An recording medium processing method as claimed in claim 20, further comprising the step of:

8) after the comparison in the step 5), receiving a selection of whether the finishing process is to be executed on the recording medium provided with the electronic tag or not.

23. A recording medium processing method as claimed in claim 17, wherein the finishing process includes at least one of the following processes (1) through (4):

(1) a stapling process for stapling a bundle of recording media that include the recording medium provided with the electronic tag;

(2) a punching process for punching a hole for filing on an edge of the recording medium;

(3) a folding process for folding the recording medium; and (4) a trimming process for cutting off an end of the recording medium.

24. An image forming method comprising the steps of:

1) accepting a printing job;

2) judging whether a finishing instruction for instructing a finishing process to be applied to a printed recording medium is included or not in the received printing job;

3) identifying a location where the finishing process is to be executed on the recording medium;

4) identifying a location of an electronic tag on the recording medium provided with the electronic tag capable of storing electronic data;

5) comparing the location where the finishing process is to be executed, which is identified in the step 3), and the location of the electronic tag identified in the step 4); and 6) notifying that the location where the finishing processes is to be executed matches with the location of the electronic tag based on a result of the comparison in the step 5).

25. An image forming method as claimed in claim 24, wherein the location of the electronic tag on the recording medium is identified from the electronic data stored in the electronic tag provided on the recording medium in the step 4).

26. An image forming method as claimed in claim 24, further comprising the step of:

7) after the comparison in the step 5), receiving a selection of whether the finishing process is to be executed on the recording medium provided with the electronic tag or not.

27. An image forming method as claimed in claim 24, wherein said finishing process comprises at least one of the following processes (1) through (4);

(1) a stapling process for stapling a bundle of recording medium;

(2) a punching process for punching a hole for filing on an edge of the recording medium;

(3) a folding process for folding the recording medium; and (4) a trimming process for cutting off an end of the recording medium.

* * * * *